US006401257B1

(12) United States Patent
Tsuruta

(10) Patent No.: US 6,401,257 B1
(45) Date of Patent: Jun. 11, 2002

(54) BUTTONHOLE AND ARTICLES USING SUCH A BUTTONHOLE

(76) Inventor: Souichi Tsuruta, 3-1-7, Aioicho, Hekinan-Shi, Aichi (JP)

( * ) Notice: Subject to any disclaimer, the term of this patent is extended or adjusted under 35 U.S.C. 154(b) by 0 days.

(21) Appl. No.: 09/752,694

(22) Filed: Jan. 3, 2001

(30) Foreign Application Priority Data

Oct. 10, 2000 (JP) ..... 2000-308680

(51) Int. Cl.[7] ..... A41F 1/02
(52) U.S. Cl. ..... 2/266
(58) Field of Search ..... 2/265, 266, 243; 24/202

(56) References Cited

U.S. PATENT DOCUMENTS

| | | | | | |
|---|---|---|---|---|---|
| 414,602 | A | * | 11/1889 | Stone | |
| 428,571 | A | * | 5/1890 | Newman | |
| 1,945,104 | A | * | 1/1934 | Zilinsky | 2/277 |
| 2,761,403 | A | * | 9/1956 | Ketterer | 112/264 |
| 2,837,805 | A | * | 6/1958 | Larkin | 24/202 |
| 3,536,554 | A | * | 10/1970 | Weiss | 156/93 |
| 3,547,060 | A | * | 12/1970 | Lepore | 112/264 |
| 3,555,570 | A | * | 1/1971 | Heagle | 2/266 |
| 3,654,635 | A | * | 4/1972 | Cruden, Jr. | 2/266 |
| 3,675,279 | A | * | 7/1972 | Moden | 24/202 |
| 3,703,149 | A | * | 11/1972 | George | 112/264 |
| 3,725,959 | A | * | 4/1973 | Cruden | 2/247 |
| 3,793,647 | A | * | 2/1974 | Spetz | 2/266 |
| 3,806,955 | A | * | 4/1974 | Weyrick et al. | 2/266 |
| 4,705,167 | A | * | 11/1987 | Nakamura | 206/348 |
| 5,419,376 | A | * | 5/1995 | Hawkins et al. | 139/384 |

* cited by examiner

*Primary Examiner*—John J. Calvert
*Assistant Examiner*—Alissa L. Hoey
(74) *Attorney, Agent, or Firm*—Armstrong, Westerman & Hattori, LLP

(57) ABSTRACT

There is disclosed a buttonhole, in which a button can be easily fastened, the button, once fastened, is not undesirably unfastened, and a deformation and rending of a cloth in which buttonhole is formed may be prevented. A buttonhole formed in a first element having a front side and a reverse side, a button provided on a second element covered by the first element, the button being insertable through the buttonhole from the reverse side of the first element so as to be exposed on the front side of the first element comprising a buttonhole body through which the button is inserted so as to fasten the first element to the second element and a reinforcing member provided on the first element for partially covering the buttonhole body from a longitudinal end thereof, the reinforcing member fixed at a fixing portion longitudinally spaced from an end of the buttonhole.

16 Claims, 25 Drawing Sheets

PRIOR ART

BUTTONHOLE AND ARTICLES USING SUCH A BUTTONHOLE

BACKGROUND OF THE INVENTION

1. Field of the Invention

The present invention relates to a buttonhole and articles using such a buttonhole.

2. Description of the Related Art

A button has been widely used as a fastening tool for fastening clothing apparel or the like, in general, the attachment of one element to another element. Normally, a button B, as shown in FIG. 33, is fastened in such a manner that an upper cloth 114 in which a buttonhole 111 is formed is overlapped on a lower cloth 113 in which a button B is provided, and the button B is inserted in the buttonhole 111 from a reverse side of the upper cloth 114 to be exposed on a front side thereof. Such a buttonhole 111 is normally formed in a linear shape having a length larger than a diameter of the button B.

When the buttonhole 111 is formed too large, the button B can be easily fastened, however, the button B, once fastened, can be often undesirably unfastened. On the contrary, when the buttonhole 111 is formed too small, in order to prevent the button B from being undesirably unfastened, it can become difficult, if not impossible, to fasten the button B in the buttonhole 111.

In addition, when the button B fastened in the buttonhole 111 is pulled in the longitudinal direction of the buttonhole 111, a thread 116 for sewing the button B on the lower cloth 113 contacts an end of the buttonhole 111, and the end of the buttonhole 111 is urged by a force toward a lower direction of the cloth, as shown in FIG. 34. As a counteraction to the force, the upper cloth 114 outside the buttonhole 111 is urged by a force toward the button B (arrow C) direction. As a result, the upper cloth 114, on an edge portion along an external periphery of the buttonhole B bends upward to lose shape of the upper cloth 114. Also, the thread 116 contacts the end of the buttonhole 111, which may cause rending or tearing of the buttonhole 111.

Further, the button B itself may be made to have various colors and designs, and there already exists many ornamental buttons. However, there have not been so many buttonholes to demonstrate a novel ornamental design in cooperation with the button B.

It is therefore an object of the present invention to provide a buttonhole, in which the button can be easily fastened, the button, once fastened, is not often undesirably unfastened, and a deformation and rending of the upper cloth may be prevented. It is also another object of the present invention to provide various ornamental articles using such a buttonhole.

SUMMARY OF THE INVENTION

In order to achieve the above-mentioned objects, there is provided a buttonhole formed in a first element having a front side and a reverse side, a button provided on a second element covered by the first element, the button being insertable through the buttonhole from the reverse side of the first element so as to be exposed on the front side of the first element comprising a buttonhole body through which the button is inserted so as to fasten the first element to the second element and a reinforcing member provided on the first element for partially covering the buttonhole body from a longitudinal end thereof, the reinforcing member fixed at a fixing portion longitudinally spaced from an end of the buttonhole.

According to the present invention, as the reinforcing member is provided and fixed on the first element at a fixing portion longitudinally spaced from the buttonhole body, the reinforcing member partially covering the buttonhole body does not interfere with the button being inserted from the reverse side of the first element. Thus, the button can be easily fastened in the buttonhole. Also, an opening of the buttonhole of the front side is narrowed by the reinforcing member, the button fastened so as to be exposed on the opening is not often undesirably unfastened.

Further, when the button fastened in the buttonhole is pulled in the longitudinal direction of the buttonhole, a thread for fixing the button in the second element contacts the edge of the buttonhole. At this time, the reinforcing member extending interiorly of the end of the buttonhole is deformed toward the end of the buttonhole. As a result, the buttonhole 10 increases the exposed size by a certain amount in the longitudinal direction so that the reinforcing member functions as a cushion to release the force applied to the first element. Also, when the button is pulled in the longitudinal direction, there is generated a force to the reinforcing member in the direction of second element. Therefore, bending and deformation of the first element can be prevented. Also, the rending of the buttonhole due to the contact of the thread to the end of the buttonhole body can be prevented.

Moreover, when the first element and the reinforcing member are made to have a different design or color, various ornamental articles can be provided in combination with the design and the color of the button.

The buttonhole of the present invention can be utilized in various articles using a button as a fastening tool such as clothes, underwear, emblems, buckles, pockets and bags.

DESCRIPTION OF THE PREFERRED EMBODIMENT

The preferred embodiments of the present invention will now be described in further detail.

Figure 1:
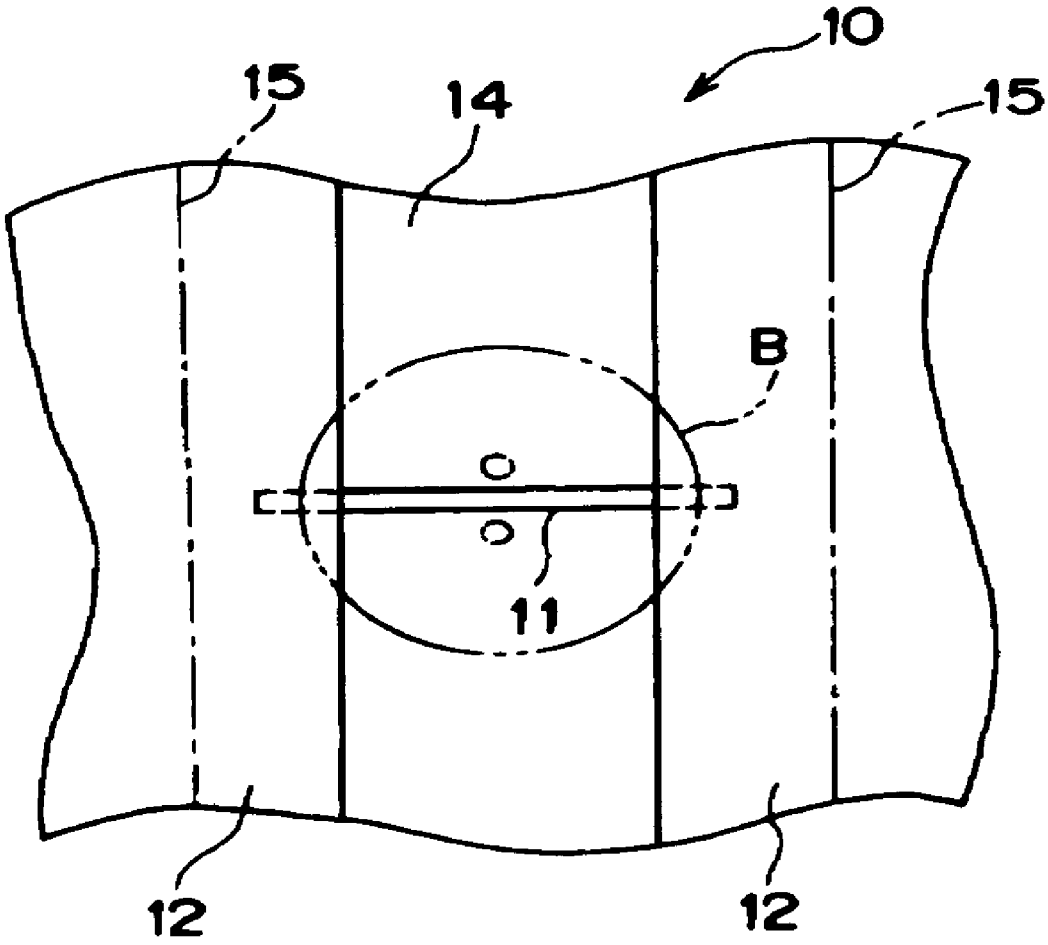
FIG. 1 is a plan view showing a first embodiment of a buttonhole of the present invention.
Figure 2:
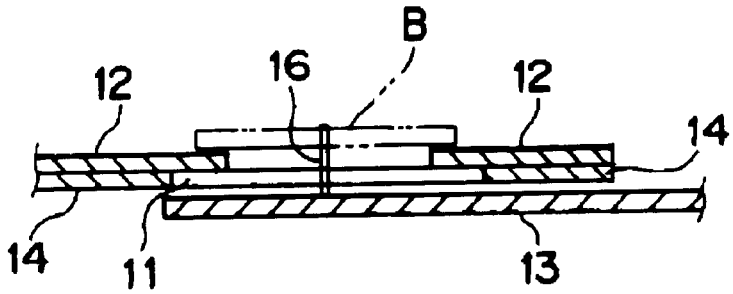
FIG. 2 is a sectional view showing the first embodiment of the buttonhole of the present invention.
Figure 3:
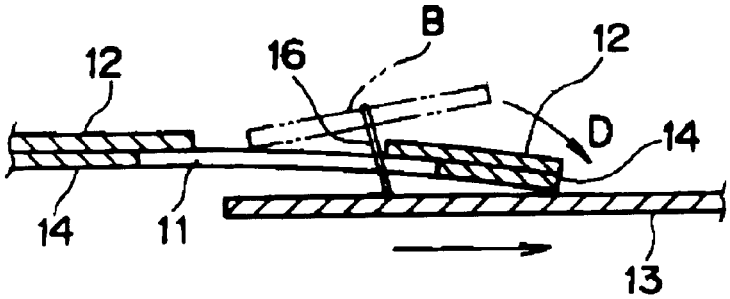
FIG. 3 is a sectional view showing a function of the buttonhole of the present invention.

FIGS. 1–3 show a buttonhole of the first embodiment of the present invention. The buttonhole 10 includes a buttonhole body 11 in which a button B is inserted so as to be fastened thereto and two reinforcing cloths or members 12 provided at both ends of the buttonhole body 11 to partially cover the buttonhole body 11.

The buttonhole body 11 is an opening formed in an upper cloth or element 14, which is overlapped on a lower cloth or element 13 on which the button B is sewed. The buttonhole body 11 is normally formed in a linear shape having a length greater than a diameter of the button B.

The reinforcing cloth 12 is sewed on the upper cloth 14 at a sewing portion 15 exterior to a peripheral, lengthwise edge of the buttonhole body 11. An inner edge of the reinforcing cloth 12, as a free edge, partially covers the buttonhole body 11 from each of the longitudinally extending ends of the buttonhole body 11. The distance between the inner edges of the reinforcing cloths 12 is normally set to be slightly less than a diameter of the button B. The reinforcing cloth 12 may be made of the same material or different material from upper cloth 14, as long as the reinforcing cloth 12 has a degree of flexibility.

When the button B is fastened in the buttonhole 10 having the above structure, the button B is inserted in the buttonhole body 11 from the reverse side of the upper cloth 14 to be exposed on the front side of the upper cloth 14, covering the inner edges of the reinforcing cloths 12. The reinforcing cloths 12 do not interfere the button B being inserted in the buttonhole 10 since the buttonhole body 11 is made larger than a diameter of the button B, the inner edges of the reinforcing cloths 12 extending interiorly of the ends of the buttonhole body 11 have a degree of flexibility and the reinforcing cloth 12 is sewed on the upper cloth 14 at the sewing portions 15 exterior to the ends of the buttonhole body 11. Once the button B is fastened in the buttonhole 10, the button B exposed on and covering the reinforcing cloths 12 cannot be easily unfastened since the distance between the inner edges, i.e., the edges of the reinforcing members that are opposite to the sewing portion 15, of the reinforcing cloth 12 is set smaller than the diameter of the button. B When the button B fastened in the buttonhole 10 is pulled in a longitudinal direction of the buttonhole 10, a thread 16 contacts the edge of the reinforcing cloth 12 extending interiorly of the ends of the buttonhole body 11 to deform the reinforcing cloth 12 toward an end of the buttonhole 10. As a result, the buttonhole 10 increases the exposed size by a certain amount, depending on the material, and the reinforcing cloth 12 functions as a cushion to release the force applied to the upper cloth 14, and there is generated a force to the reinforcing cloth 12 in the direction of the lower cloth 13 (arrow D direction). Therefore, bending of the upper cloth 14 in an upper direction and the deformation of the upper cloth 14 may be prevented. Also, the rending of the buttonhole 11, caused by the contact of the thread 16 to the end of the buttonhole body 11, may be prevented.

When the upper cloth 14 and the reinforcing cloth 12 are made to have different colors or designs, various ornamental articles can be provided in combination with the button B.

In the above description, the reinforcing cloths 12 are provided at both ends of the buttonhole body 11, however, the reinforcing cloth 12 can be provided at only one end of the buttonhole body 11.

Next, other embodiments of the buttonhole of the present invention are described. In the following description, the same features as those previously described are denoted by the same reference numerals and the detailed description thereof is omitted.

Figure 4:
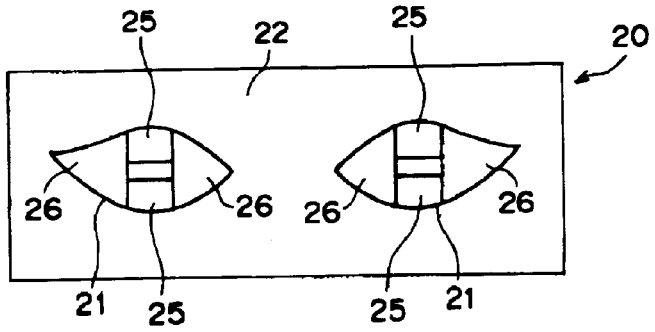
FIG. 4 is a plan view showing a second embodiment of a buttonhole of the present invention.
Figure 5:
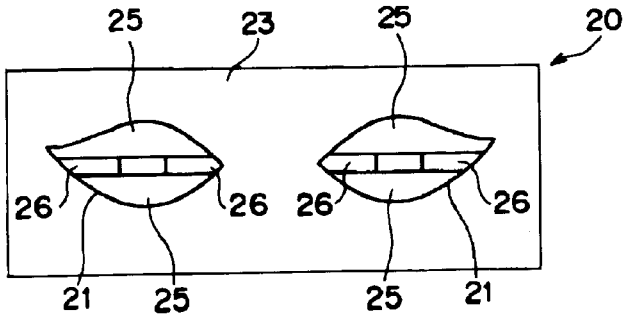
FIG. 5 is a rear view showing the second embodiment of the buttonhole of the present invention.
Figure 6:
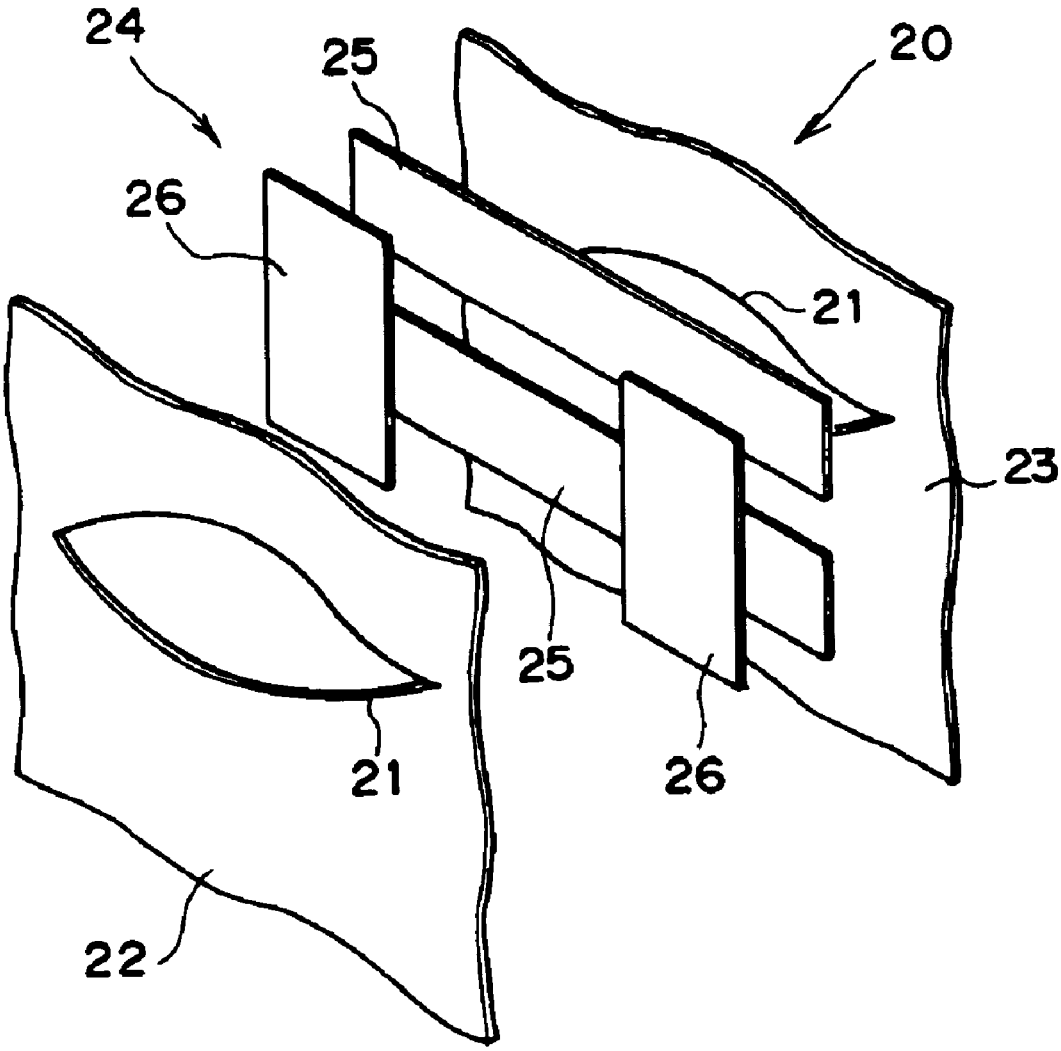
FIG. 6 is a broken perspective view showing the second embodiment of the buttonhole of the present invention.

FIGS. 4–6 show a buttonhole of the second embodiment of the present invention. The button hole 20 includes a front member 22 and a reverse member 23 having holes 21. Between the front member 22 and the reverse member 23, a buttonhole-forming member 24 is provided.

Figure 7:
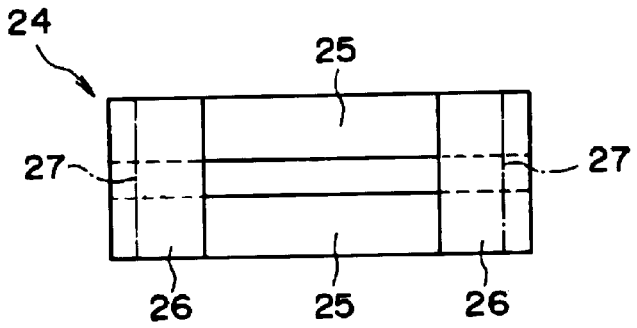
FIG. 7 is a plan view showing a buttonhole-forming member.

The buttonhole-forming member 25, as shown in FIGS. 6 and 7, includes two first band members 25 arranged in parallel and having a small amount of gap therebetween, and two second band members 26 interacting with and connecting the first band members 25. The second band members 26 are sewed or adhered by adhesives at the fixing portion 27 of the longitudinal edge of the first band members 25, as shown in FIG. 7. The first band member 25 and the second band member 26 are normally made of a flexible material, such as cloth.

Figure 8:
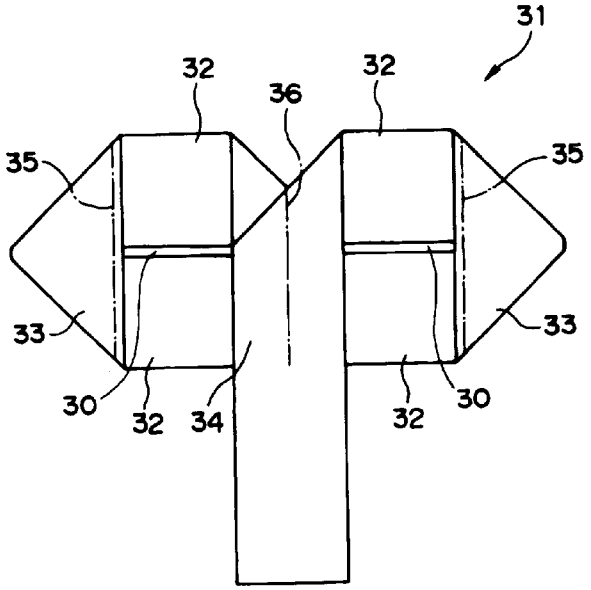
FIG. 8 is a plan view showing a third embodiment of a buttonhole of the present invention.

In the above buttonhole-forming member 24, the gap between the first band members 25 functions as the buttonhole body and second band members 26 function as the reinforcing cloths. Therefore, according to the embodiment of the buttonhole 20, the button can be easily fastened, the button once fastened is not undesirably unfastened, and the deformation of the first band members 25 and the rending of the buttonhole can be prevented. In addition, when the first band member 25 is made of black material, the second band member 26 of white material and the buttonhole-forming member 24 is exposed from a streamlined hole 21, a buttonhole expressing eye of a human or an animal can be FIG. 8 shows a buttonhole of a third embodiment of the present invention. The buttonhole 30 is made by a buttonhole-forming member 31, in which a single band member is folded a plurality of times. The buttonhole-forming member 31 includes a parallel portion 32 in which two bands members are arranged in parallel, i.e., parallel to each other. Both ends of the parallel portion 32 are covered by outer folded portions 33, and a vertical portion 34 is provided to intersect the parallel portion 32 at a right angle. The outer folded portion 33 is adhered by an adhesive or sewed on the parallel portion 32 at a fixing portion 35 which is spaced from an inner end of the outer folded portion 32, and the vertical portion 34 is adhered by an adhesive or sewed on the parallel portion 32 at a fixing portion 36 which is center of the vertical portion 34.

Figure 9:
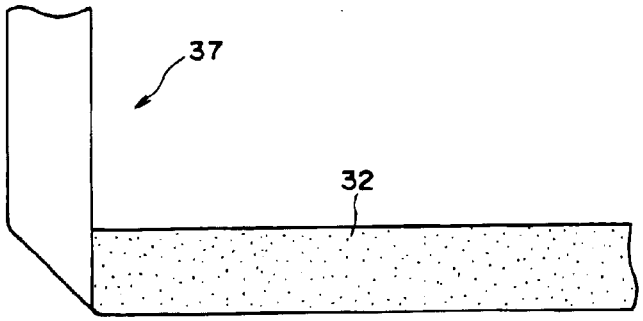
FIG. 9 is a plan view showing a method for producing the buttonhole of the third embodiment of the present invention.
Figure 10:
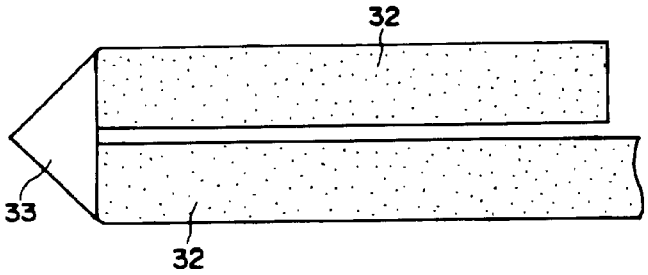
FIG. 10 is a plan view showing the method for producing the buttonhole of the third embodiment of the present invention.
Figure 11:
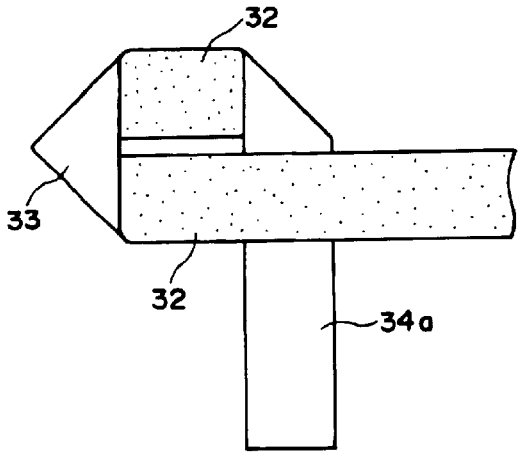
FIG. 11 is a plan view showing the method for producing the buttonhole of the third embodiment of the present invention.

The buttonhole-forming member 31 may be produced in the following manner. At first, one end of a band member 37 is folded two times so that one end of the band member 37 forms the parallel portion 32 and the outer folded portion 33 having a triangle shape covers one end of the parallel portion, as shown in FIGS. 9 and 10. Next, the other end of the parallel portion 32 is folded so as to form a first vertical portion 34a, as shown in FIG. 11.

Figure 12:
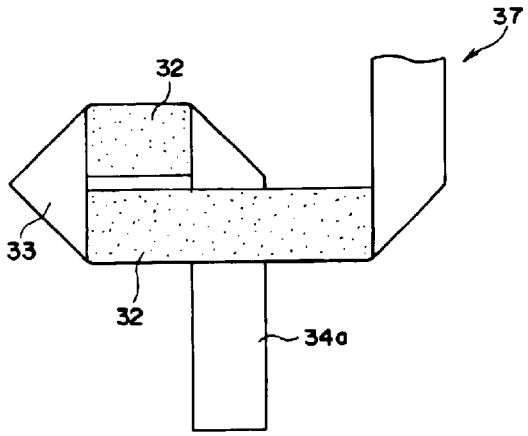
FIG. 12 is a plan view showing the method for producing the buttonhole of the third embodiment of the present invention.
Figure 13:
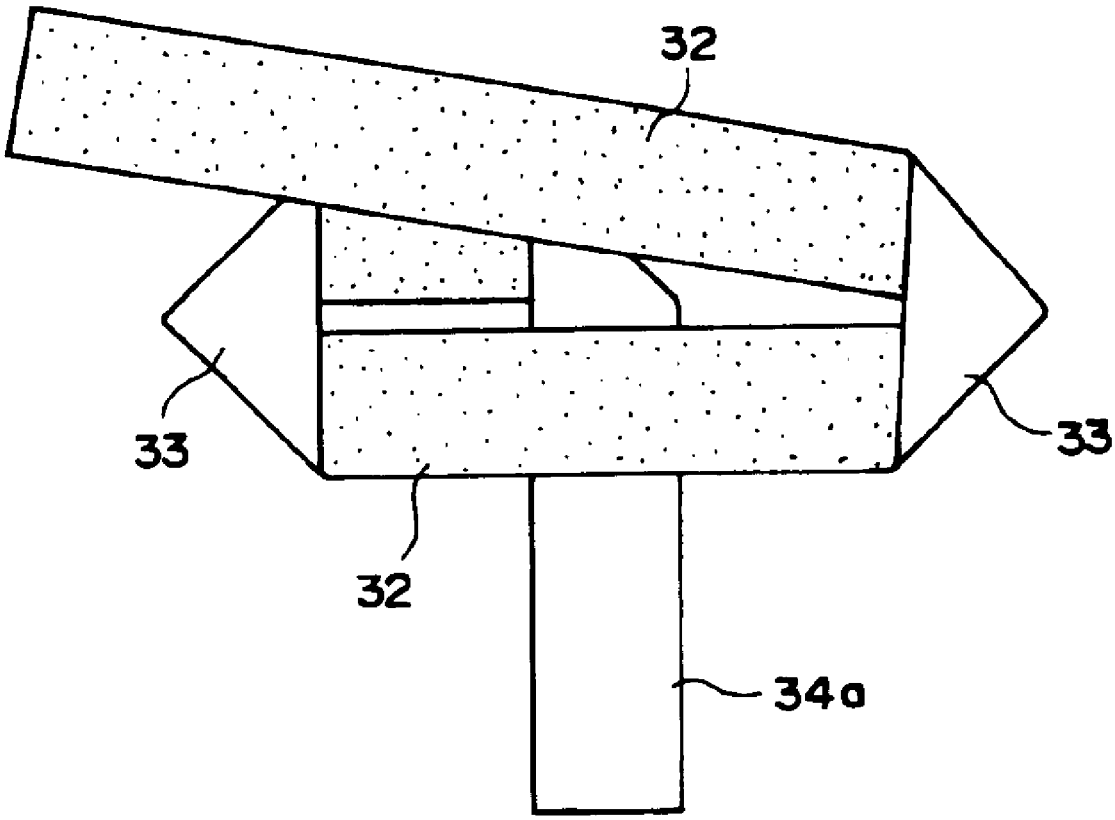
FIG. 13 is a plan view showing the method for producing the buttonhole of the third embodiment of the present invention.
Figure 14:
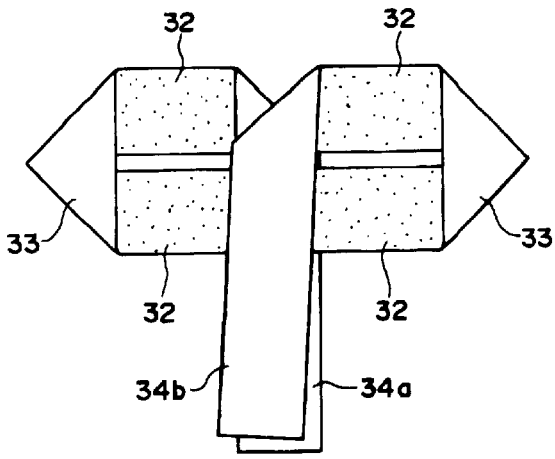
FIG. 14 is a plan view showing the method for producing the buttonhole of the third embodiment of the present invention.

In the same manner, the other end of a band member 37 is folded two times so that the other end of the band member 37 forms the parallel portion 32 and the outer folded portion 33 having a triangle shape covers at the end of the parallel portion 32, as shown in FIGS. 12 and 13. Next, the band member is folded so that the other end of the band member covers the central surface of the parallel portion 32 and the other end is overlapped on the first vertical portion 34*a* to form a second vertical member 34*b* which intersect the parallel portion 32 at a right angle, as shown in FIG. 14.

Figure 15:
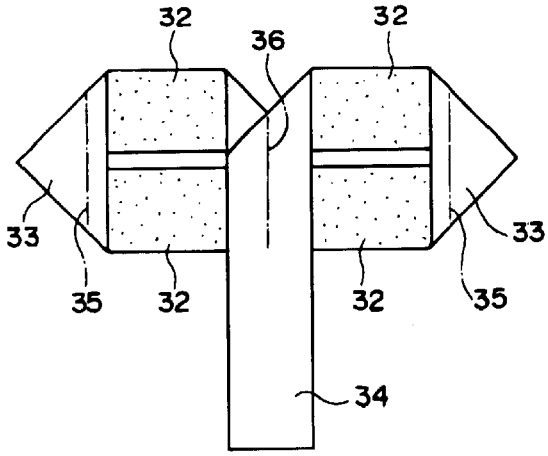
FIG. 15 is a plan view showing the method for producing the buttonhole of the third embodiment of the present invention.

Next, the outer folded portion 33 is adhered by an adhesive or sewed on the parallel portion 32. After that, the first vertical portion 34*a* is overlapped on the second vertical portion 34*b* and the overlapped vertical portions 34*a*, 34*b* are adhered by an adhesive or sew on the parallel portion 32 to form the vertical portion 34, as shown in FIG. 15.

In the buttonhole forming member 31, the gap between the band member in the parallel portion 32 functions as a buttonhole body and the outer folded portion 33 functions as the reinforcing member. Therefore, according to the present invention, a buttonhole may be provided in which the button can be easily fastened, the button, once fastened, is not often undesirably unfastened and the buttonhole is not easily rent. Also, novel articles having buttonholes may be provided only by folding a single band member.

Figure 16:
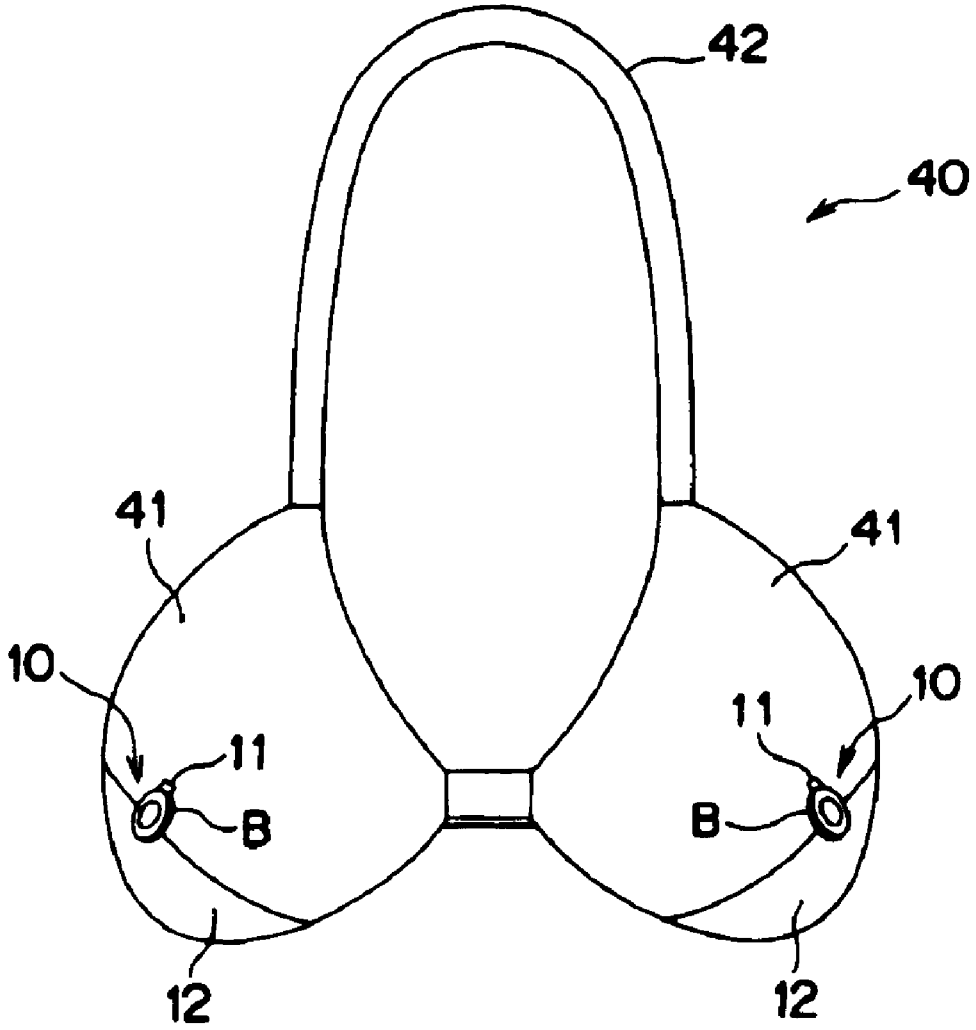
FIG. 16 is a front view showing a brassiere using the buttonhole of the present invention.
Figure 17:
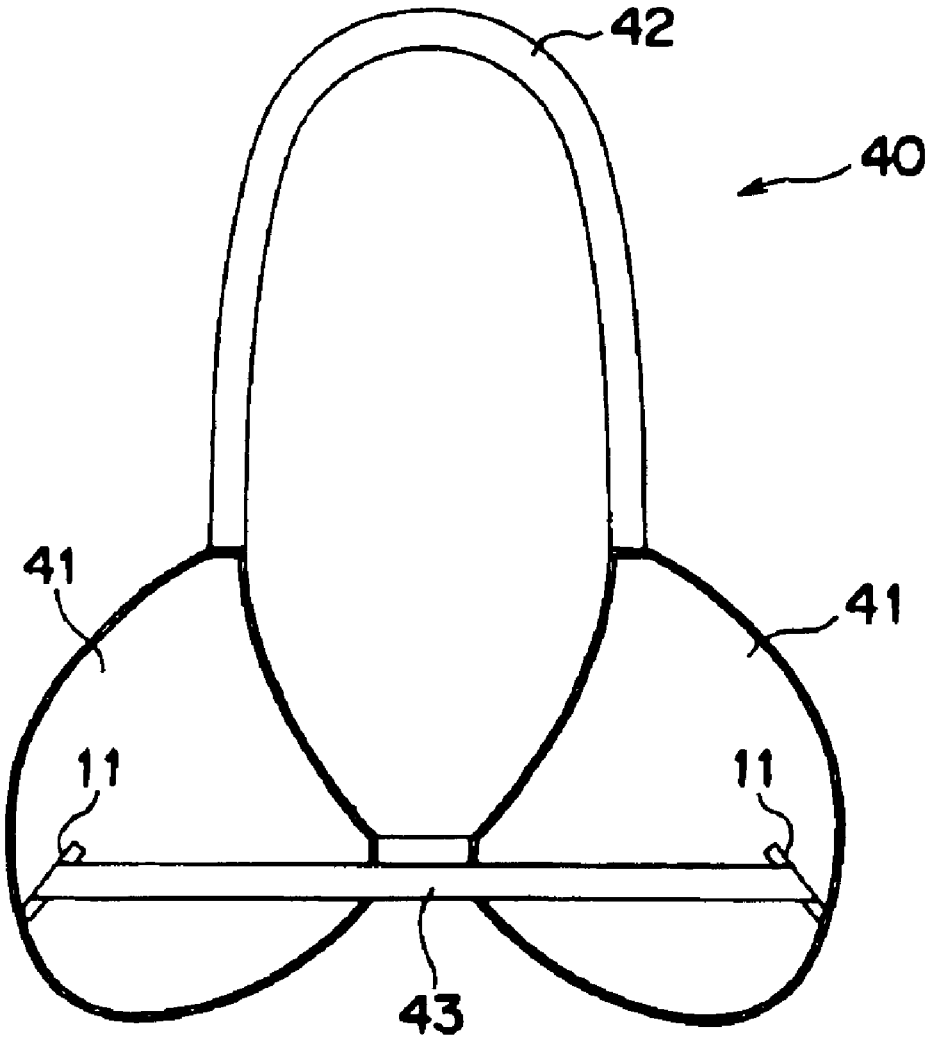
FIG. 17 is a rear view showing the brassiere using the buttonhole of the present invention.
Figure 18:
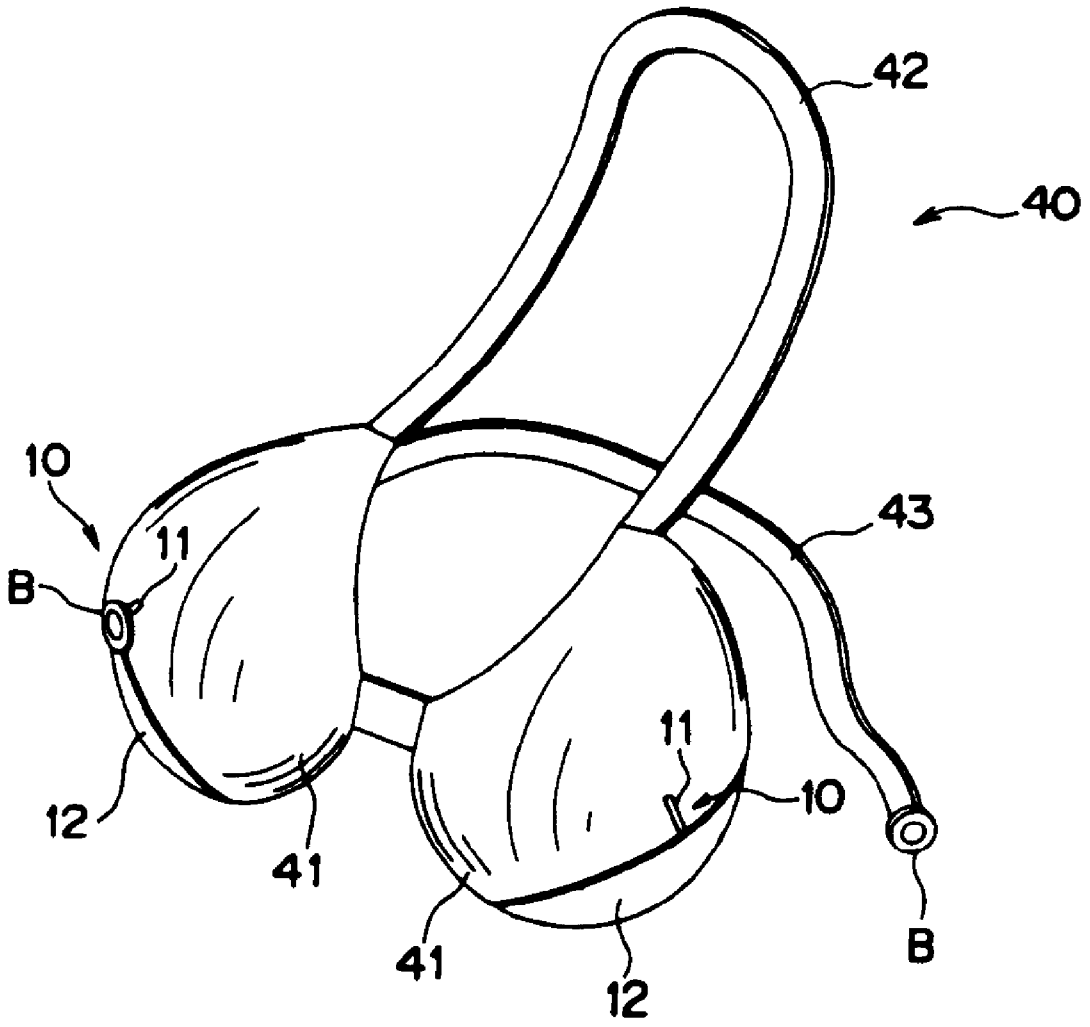
FIG. 18 is a perspective view showing the brassiere using the buttonhole of the present invention.

Hereinafter, various articles having the above-mentioned buttonhole will be described. FIGS. 16–18 show a brassiere 40 in which the buttonholes 10 shown in FIGS. 1–3 are utilized. The brassiere 40 includes two cup portions 41, a neck strap portion 42, and a back strap portion 43 which has buttons B at both ends thereof. In the lower part of each cup portion 41, a buttonhole body 11 is formed having a length larger than a diameter of the button B. Also in the lower part of each cup portion 41, the reinforcing cloth 12 is provided, which covers a part of the buttonhole body 11 from an outer edge of the buttonhole body 11 in a longitudinal direction.

The brassiere 40 is worn in a manner that the buttons B are fastened by being inserted the buttonholes 10 from rear sides of the cup portion 41. According to the present invention, the brassiere 40 is provided in which the button B can be easily fastened and the button, once fastened, is not undesirably unfastened. In addition, when the back strap portion 43 is pulled toward the outer edge of the buttonhole 10 due to movement of the person wearing the brassiere 40, the reinforcing cloth 12 is deformed toward edges of the buttonhole 10, depending on direction of movement, and the buttonhole 10 increases the size of its exposure in a longitudinal direction. Thus, the reinforcing cloth 12 works as a cushion to release the force applied to the cup portion 41. Therefore, a brassiere 40 is provided, in which the deformation of the cup portion 41 and rending of the buttonhole 10 is prevented, and which is comfortably worn.

Figure 19:
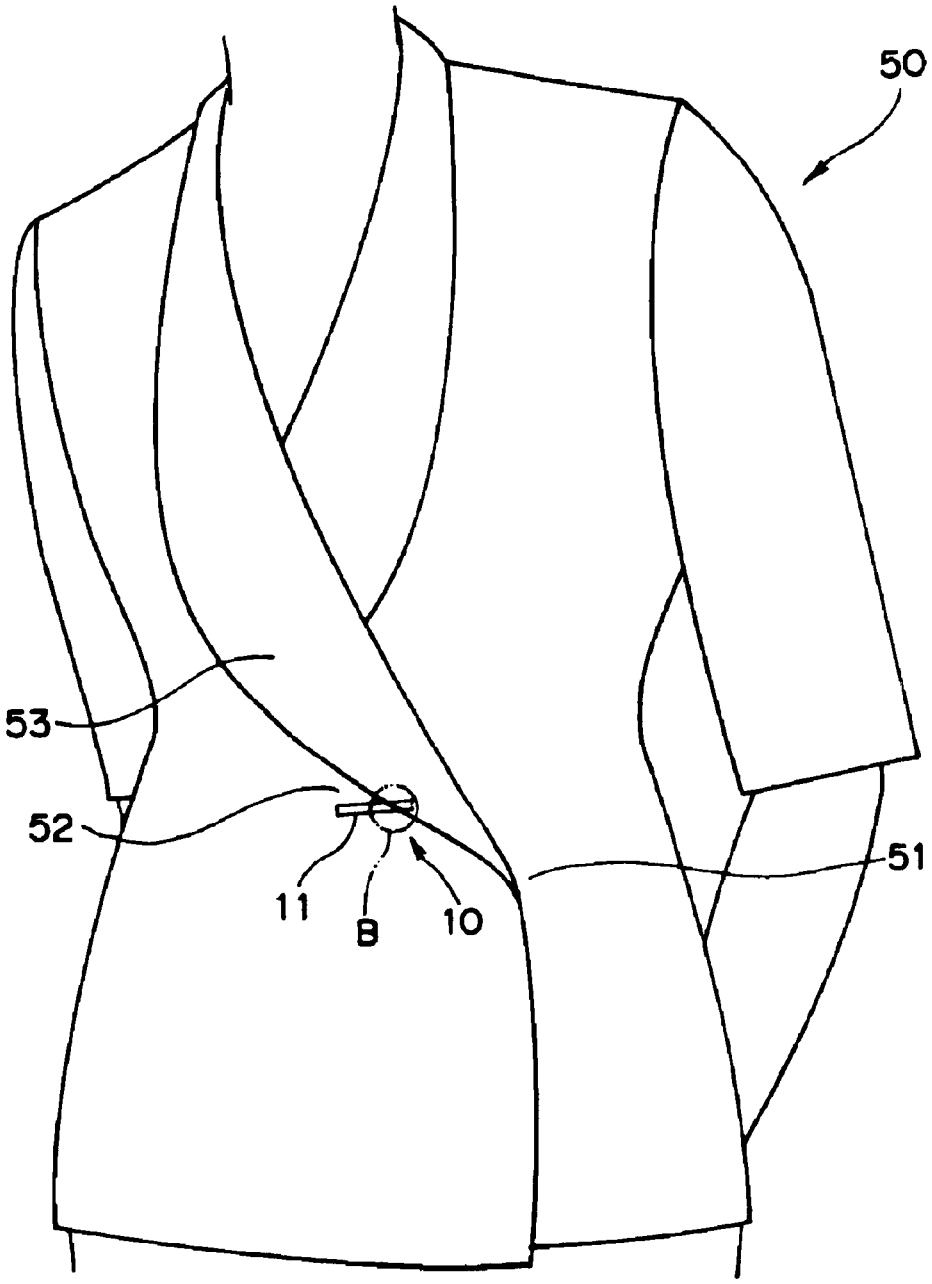
FIG. 19 is a perspective view showing a jacket using the buttonhole of the present invention.

FIG. 19 shows a jacket 50 in which the buttonhole 10 shown in FIGS. 1–3 is utilized. The jacket 50 includes a first front seam portion 51 in which the button is provided and a second seam portion 52 which is overlapped on the first seam portion. In the second seam portion 52, the buttonhole 10 is formed.

The second seam portion of the jacket 50 is folded so as to form a collar portion 53. An edge of the collar portion 53 partially covers the buttonhole body 11 from the edge of the buttonhole body 11. The part of the collar portion 53 covering the buttonhole body 11 functions as the reinforcing cloth.

The jacket 50 is worn in a manner that the second front seam portion 52 is overlapped on the first seam portion 51 and the button B provided in the first front seam portion 51 is fastened in the buttonhole 10 formed in the second front seam portion 52. According to the present invention, the jacket 50 can be provided, in which the button B can be easily fastened, the button B, once fastened, is not often undesirably unfastened and deformation of the second front seam portion 52 and rending of the buttonhole 10 is presented.

Figure 20:
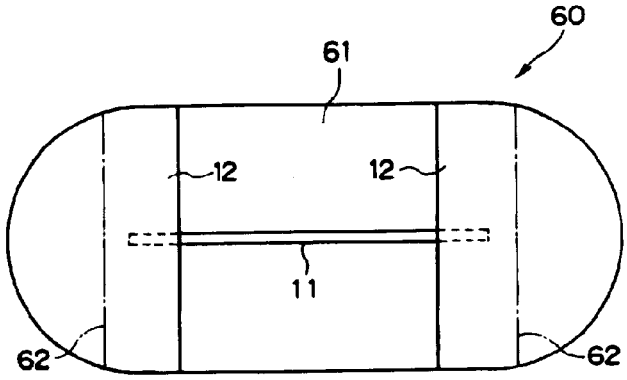
FIG. 20 is a plan view showing a buckle using the buttonhole of the present invention.
Figure 21:
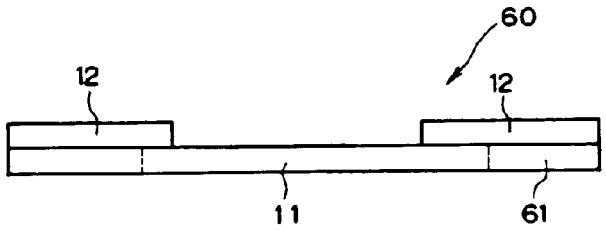
FIG. 21 is a sectional view showing the buckle using the buttonhole of the present invention.
Figure 22:
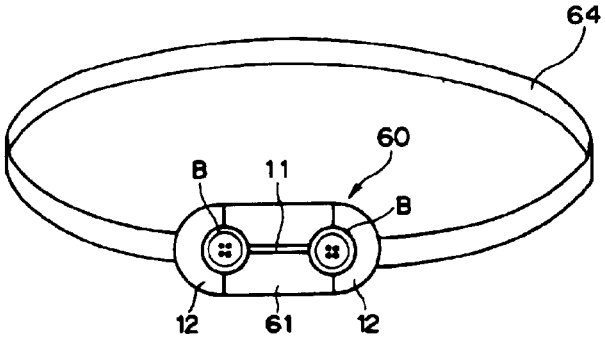
FIG. 22 is a perspective view showing the buckle using the buttonhole of the present invention.
Figure 23:
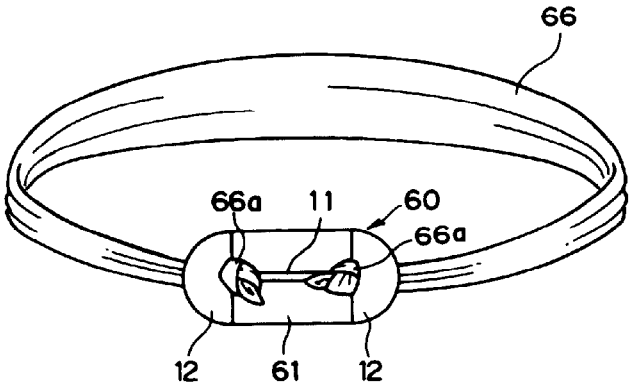
FIG. 23 is another perspective view showing the buckle using the buttonhole of the present invention.
Figure 24:
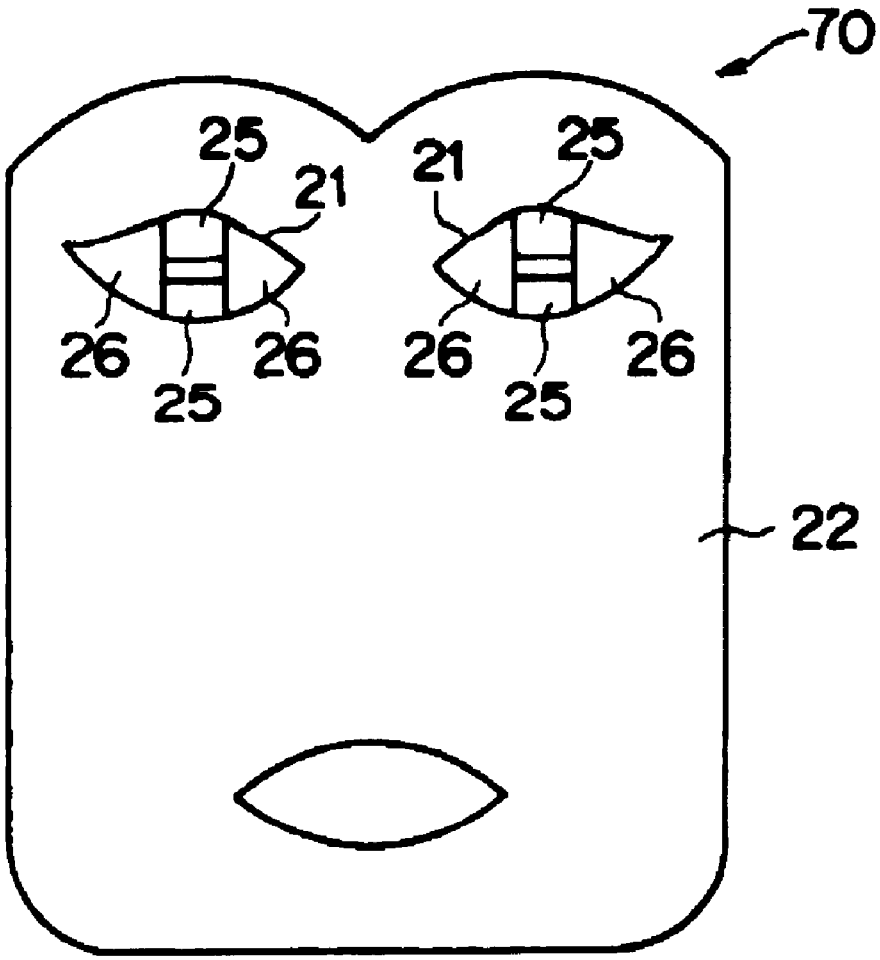
FIG. 24 is a plan view showing an emblem using the buttonhole of the present invention.
Figure 25:
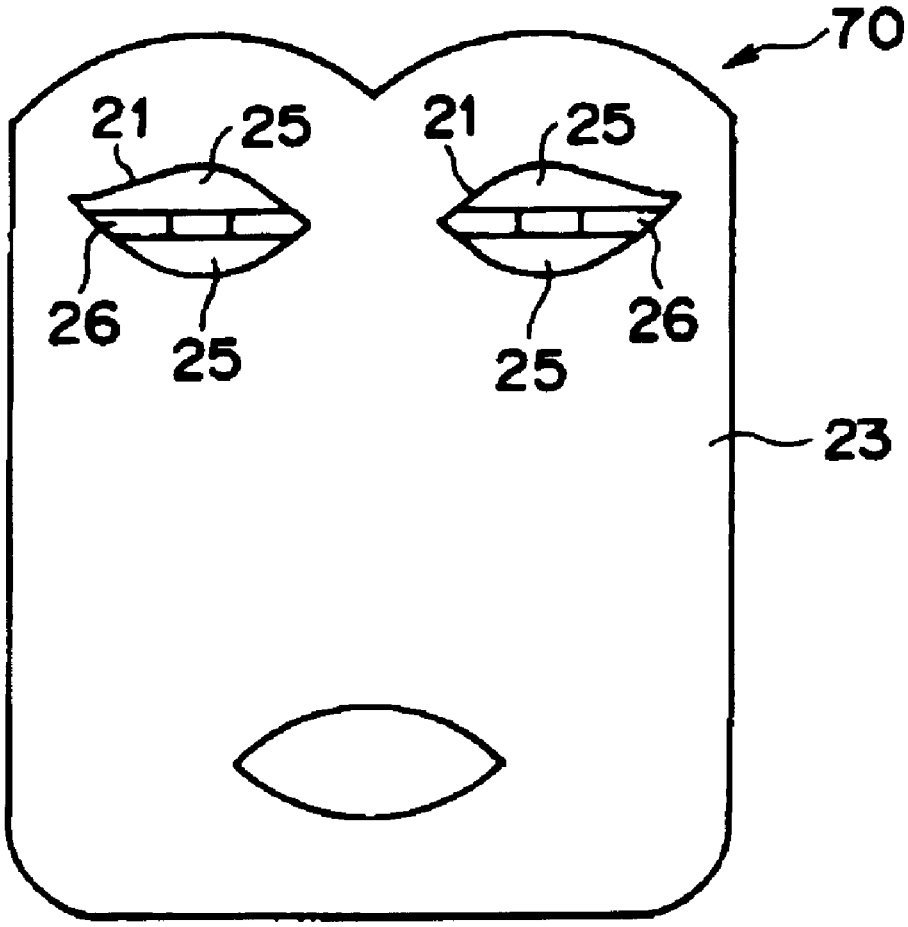
FIG. 25 is a rear view showing the emblem using the buttonhole of the present invention.

FIGS. 20 and 21 show a buckle 60 in which the buttonhole 10 shown in FIGS. 1–3 is utilized. The buckle 60 includes a base member 61 having a long-circular shape and the reinforcing cloth 12 provided at both ends of the base member 61. In the base member 61, the buttonhole body 11 is formed along a longitudinal direction of the base member 61, and both edges of the buttonhole body 11 are covered by the reinforcing cloths 12. The reinforcing cloth 12 is adhered by an adhesive or sewed on the base member 61 at fixing portions located exteriorly the edges of the buttonhole body 11. The buckle 60 is used to fasten the buttons B provided at both ends of a belt 64 as shown in FIG. 22 or to fasten knots 66*a*, which function as the buttons, formed at both ends of a band member 66 as shown in FIG. 23.

According to the present invention, when the belt 64 or the band member 66 is pulled toward the edge of the buttonhole 10, due to movement of the person wearing the buckle 60, the reinforcing cloth 12 is deformed toward an edge or edges of the buttonhole 10 and the exposure of the buttonhole 10 increases in size in a longitudinal direction and functions as a cushion to release the force applied to the buckle 60. Therefore, a buckle 60 is provided, in which the deformation of the buckle 60 and rending of the buttonhole 10 are prevented, and which is comfortably worn.

Figure 26:
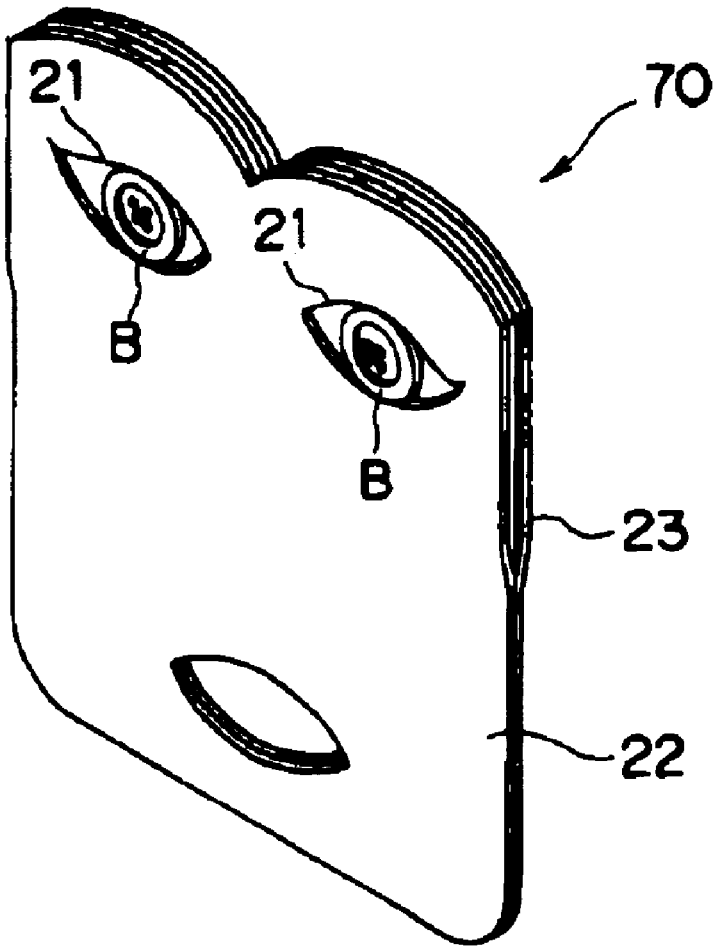
FIG. 26 is a perspective view showing the emblem using the buttonhole of the present invention.
Figure 27:
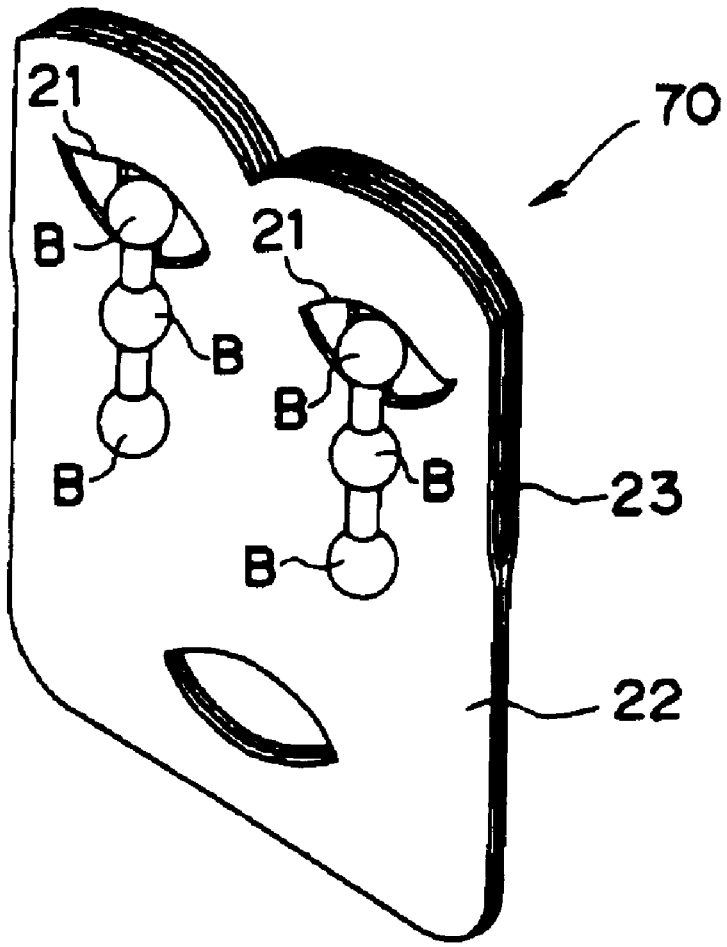
FIG. 27 is another perspective view showing the emblem using the buttonhole of the present invention.

FIGS. 24–27 show an emblem 70 in which the buttonholes 20 shown in FIGS. 4–6 are utilized. In the emblem 70, the buttonhole-forming member 24 is provided between the front member 22 and the reverse member 23 and these members are incorporated. The emblem 70 can be used in a manner that the buttons provided on a shirt or a jacket are fastened in the buttonholes of the emblem 70. According to the present invention, the emblem can be easily fastened by the buttons and the emblem once fastened is not undesirably unfastened. Also, by forming the first reinforcing member in black material and the second reinforcing member in white material, the buttonholes are provided expressing eyes of a human or animal, as shown in FIG. 26. In this case, when a plurality of spherical buttons are connected in series and an end of the connected buttons is dangled from the buttonhole as show in FIG. 27, the emblem can be provided which expresses tears dropping from the eyes.

Figure 28:
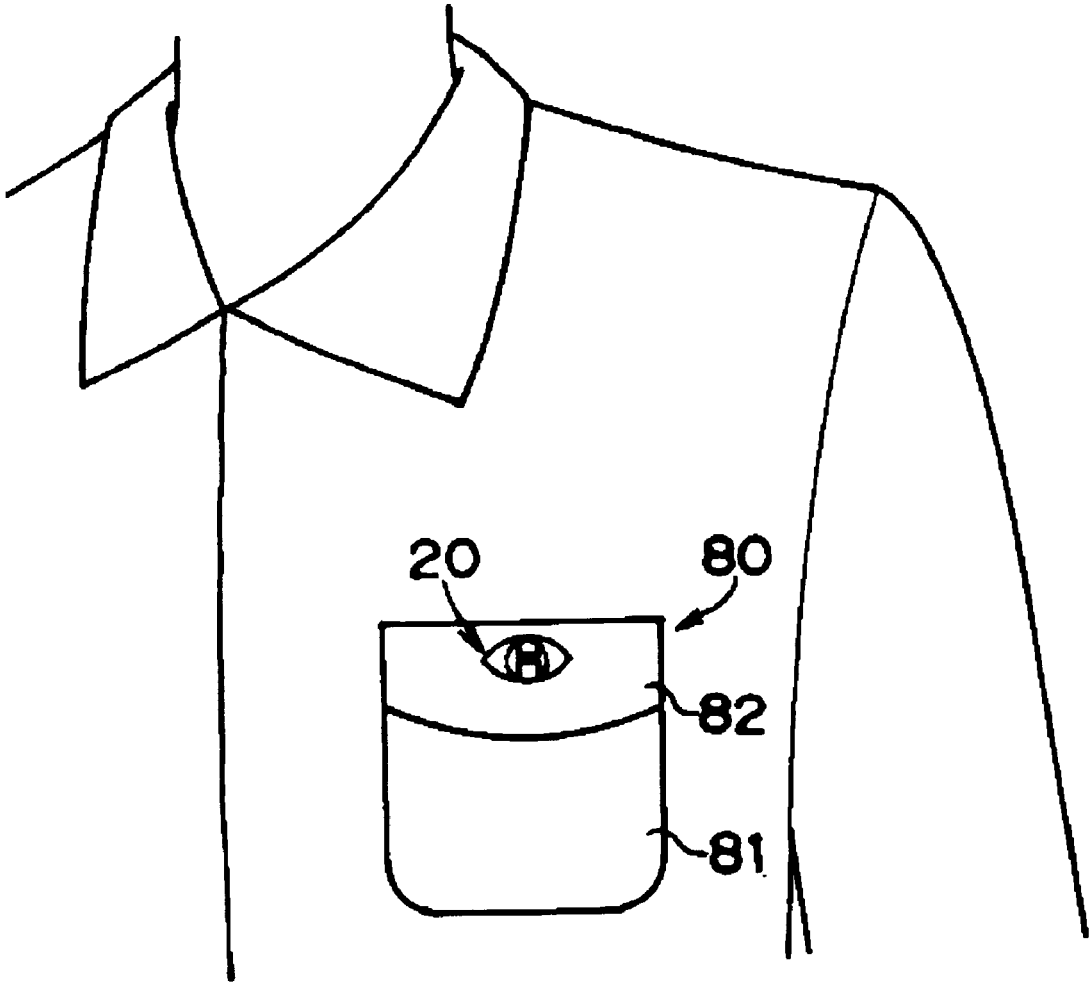
FIG. 28 is a front view showing a pocket using the buttonhole of the present invention.
Figure 29:
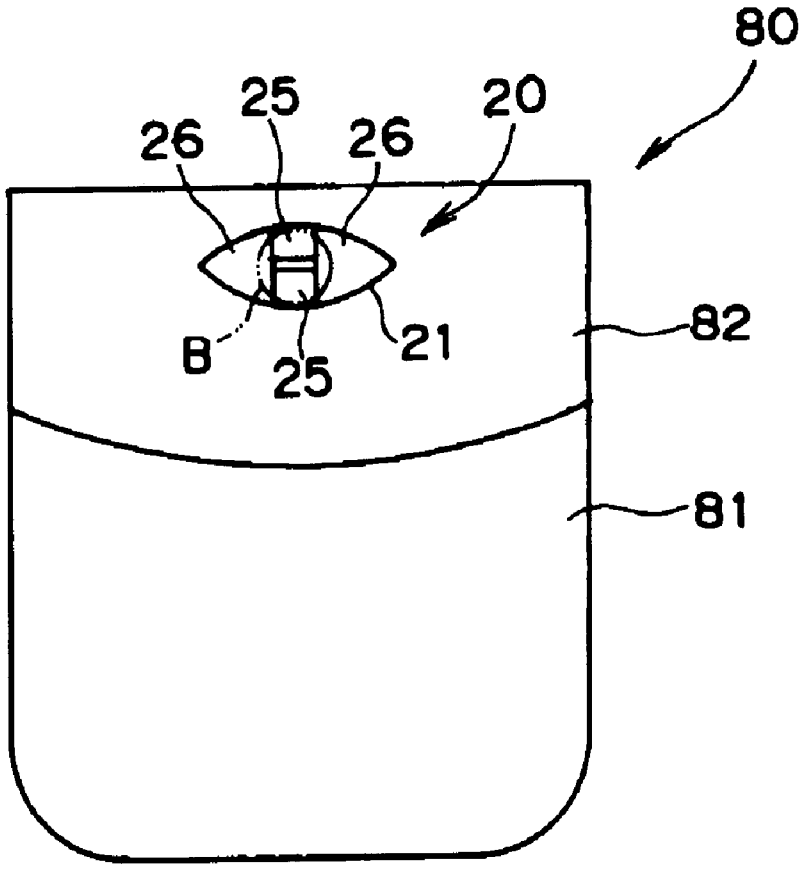
FIG. 29 is an enlarged front view showing the pocket using the buttonhole of the present invention.

FIGS. 28 and 29 show a pocket 80 in which the buttonhole 16 shown in FIGS. 4–6 is utilized. The pocket 80 includes a container portion 81 for containing articles and a flap 82 for covering an upper opening of the container portion 81. The button B is provided on the surface of the container portion 81 and the buttonhole 20 for fastening the buttons B are formed in the flap 82. According to the pocket 80, the flap 82 is easily fastened and the flap 82 once fastened is not undesirably unfastened. Also, the pocket 80 can be provided for expressing the eye of a human or an animal.

Figure 30:
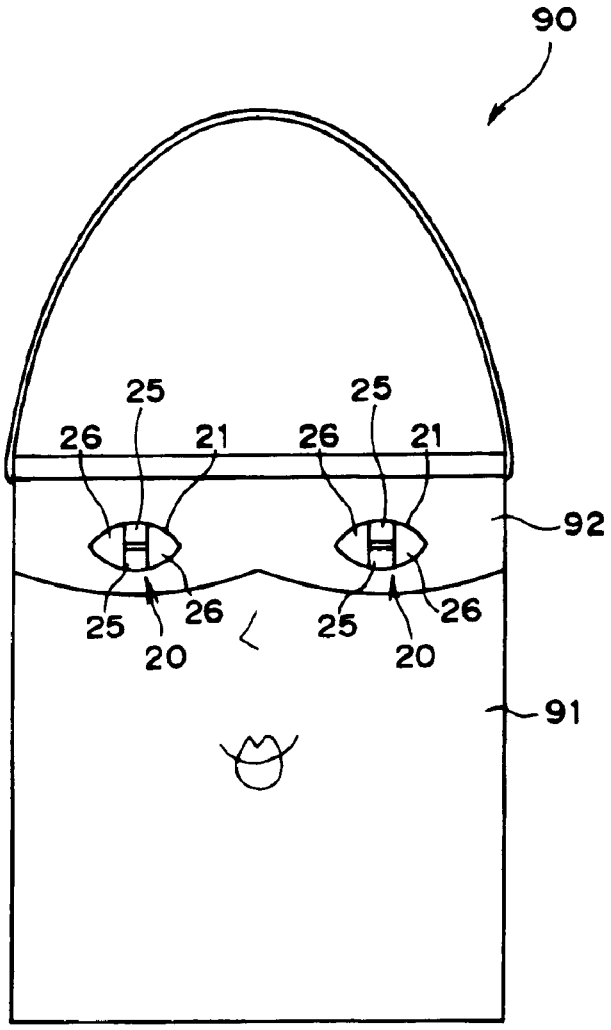
FIG. 30 is a is a front view showing a bag using the buttonhole of the present invention.
Figure 31:
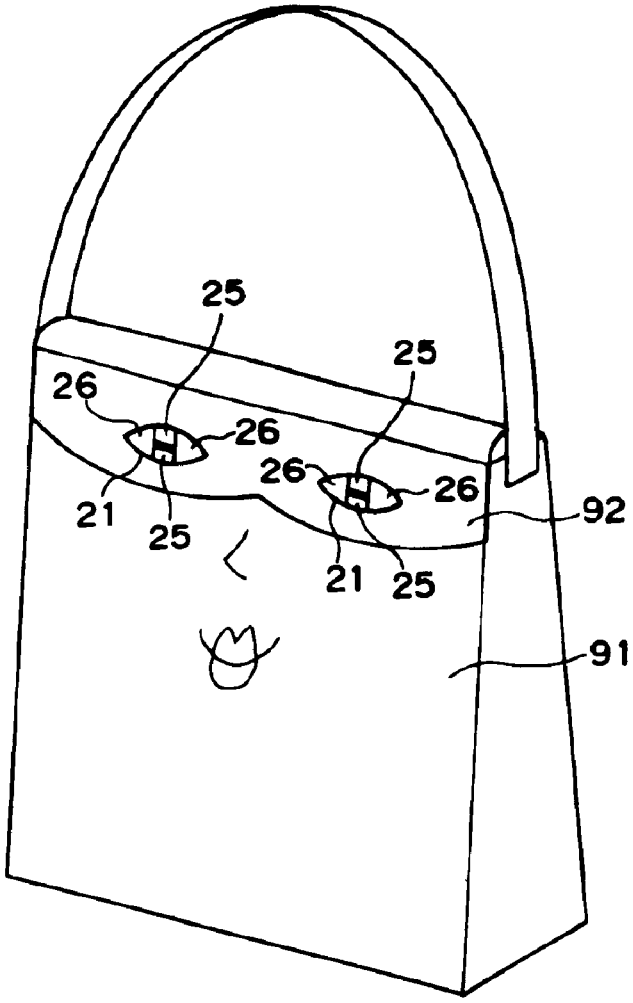
FIG. 31 is a perspective view showing the bag using the buttonhole of the present invention.

FIGS. 30 and 31 shows a bag 90 in which the buttonholes 20 shown in FIGS. 4–6 are utilized. The bag 90 includes a body 91 for containing articles and a flap 92 for covering an upper opening of the body 91. Buttons B are provided on the surface of the body 91 and the buttonholes 20 are formed in the flap 92 for fastening the buttons B. According to the bag 90, the flap 92 is easily fastened and the flap 92 once fastened is not undesirably unfastened. Moreover, when a design expressing a nose and a mouth is formed in the surface of the body 91, the bag 90 can express the face of human or animal in combination with the buttonhole 20 expressing the eyes.

Figure 32:
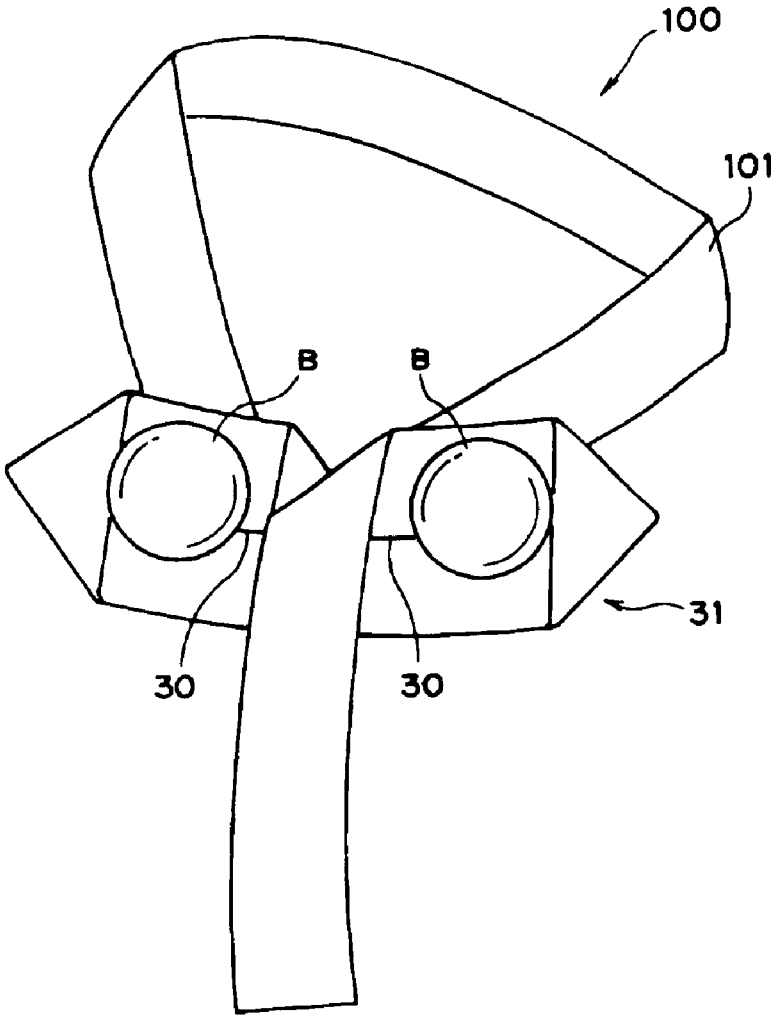
FIG. 32 is a perspective view showing a buckle using the buttonhole of the present invention.
Figure 33:
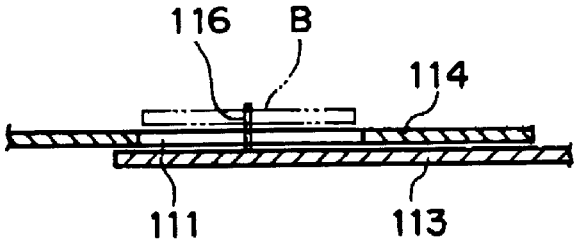
FIG. 33 PRIOR ART
FIG. 33 is a sectional view showing a conventional buttonhole.
Figure 34:
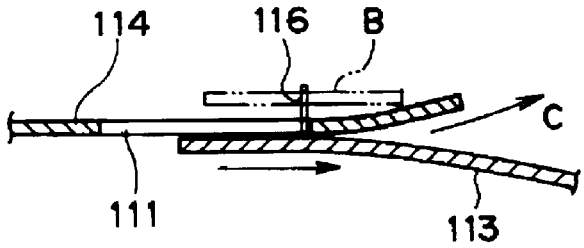
FIG. 34 is another sectional view showing the conventional buttonhole.

FIG. 32 shows a buckle in which the buttonhole 30 shown in FIG. 8 is used. The buckle 100 is utilized in the manner that the buttons B provided at both ends of a strap 101 are fastened in the buttonholes 30 of the buttonhole-forming member 31. The buckle 100 can be utilized as an ornament for the neck when the buckle 100 is positioned in front of the neck and the strap is turned around the neck. Also, the buckle can be utilized as an ornament for the ankle in the manner that the buckle 100 is positioned in front of the ankle and the strap is turned around the ankle.

As is apparent from the above description, according to the present invention, the buttonhole is provided in which the button can be easily fastened, the button once fastened is not undesirably unfastened, and the deformation of the cloth in which the buttonhole is formed and rending of the buttonhole can be prevented. Moreover, various articles having a novel design can be provided by utilizing the buttonhole.

The present invention is not limited to these embodiments, but various variations and modifications may be made without departing from the scope of the present invention. For example, the reinforcing cloth is provided at both end of the buttonhole in some of the above embodiments, however, the reinforcing cloth may be provided at one end of the buttonhole in those embodiments. Also, combination of the buttonhole and the articles is not limited to the above embodiments, but the buttonhole and articles described above can be combined in a desired manner. Further, the articles in which the buttonhole is utilized are not limited to the above embodiments, but the buttonhole can be utilized in various articles in which the button is used as a fastening tool.

What is claimed is:

1. A buttonhole formed in a first element having a front side and a reverse side, a button provided on a second element covered by said first element, the button being insertable through said buttonhole from the reverse side of said first element so as to be exposed on the front side of said first element comprising:

a buttonhole opening through which the button is inserted so as to fasten said first element to said second element; and a reinforcing member provided on said first element and partially covering said buttonhole opening from a longitudinal end thereof, said reinforcing member fixed at a fixing portion longitudinally spaced from an end of said buttonhole.

2. A buttonhole according to claim 1, wherein said buttonhole opening is formed as a gap between two band members arranged parallel to each other.

3. A buttonhole according to claim 1, wherein said buttonhole is formed by a buttonhole-forming member comprising two band members arranged parallel to each other so as to form said buttonhole opening therebetween, said two band members each having longitudinally spaced ends and a reinforcing member provided at said each longitudinal end of said band members and intersecting said band members, said buttonhole-forming member arranged to be exposed from a streamlined hole formed in said first element.

4. An article comprising:

a buttonhole formed in a first element having a front side and a reverse side, a button provided on a second element covered by said first element, the button being insertable through said buttonhole from the reverse side of said first element so as to be exposed on the front side of said first element;

a buttonhole opening through which the button is inserted so as to fasten said first element to said second element; and a reinforcing member provided on said first element and partially covering said buttonhole opening from a longitudinal end thereof, said reinforcing member fixed at a fixing portion longitudinally spaced from an end of said buttonhole.

5. The article according to claim 4, wherein said buttonhole opening is formed as a gap between two band members arranged parallel to each other.

6. The article according to claim 4, wherein said buttonhole is formed by a buttonhole-forming member comprising two band members arranged parallel to each other so as to form said buttonhole opening therebetween, said two band members each having longitudinally spaced ends and a reinforcing member provided at said each longitudinal end of said band members and intersecting said band members, said buttonhole-forming member arranged to be exposed from a streamlined hole formed in said first element.

7. The article according to claim 4, wherein the article is a brassiere comprising:

two cup portions, each of said two cup portions having said buttonhole; and a back strap portion having first and second ends, each of said first and second ends having a button secured to said buttonhole so as to fasten said back strap portion to said two cup portions.

8. The article according to claim 4, wherein the article is an outerwear garment having a folded collar portion and said buttonhole is provide in said collar portion, said reinforcing member being provided in said folded collar portion.

9. The article according to claim 4, wherein the article is an emblem.

10. The article according to claim 6, wherein the article is an emblem.

11. The article according to claim 4, wherein the article is a buckle.

12. The article according to claim 6, wherein the article is a buckle.

13. The article according to claim 4, wherein the article is a pocket comprising:

a container portion having an opening and a flap portion covering said opening, said container portion provided with said button and said flap portion provided with said buttonhole.

14. The article according to claim 6, wherein the article is a pocket comprising:

a container portion having an opening and a flap portion covering said opening, said container portion provided with said button and said flap portion provided with said buttonhole.

15. The article according to claim 4, wherein the article is bag comprising:

a container portion having an opening and a flap portion covering said opening, said container portion provided with said button and said flap portion provided with said buttonhole.

16. The article according to claim 6, wherein the article is a bag comprising:

a container portion having an opening and a flap portion covering said opening, said container portion provided with said button and said flap portion provided with said buttonhole.

* * * * *